US005785316A

United States Patent [19]

Schulze

[11] Patent Number: 5,785,316

[45] Date of Patent: Jul. 28, 1998

[54] MONEY-OPERATED SLOT MACHINE

[75] Inventor: Ullrich Schulze, Wiesbaden, Germany

[73] Assignee: NSM Aktiengesellschaft, Bingen, Germany

[21] Appl. No.: 663,139

[22] PCT Filed: Dec. 7, 1994

[86] PCT No.: PCT/DE94/01457

§ 371 Date: Jun. 18, 1996

§ 102(e) Date: Jun. 18, 1996

[87] PCT Pub. No.: WO95/16979

PCT Pub. Date: Jun. 22, 1995

[30] Foreign Application Priority Data

Dec. 18, 1993 [DE] Germany ..... 43 43 347.2

[51] Int. Cl.[6] ..... A63F 5/02

[52] U.S. Cl. ..... 273/142 H; 273/144 B

[58] Field of Search ..... 273/142 H, 142 HA, 273/142 J, 144 R, 144 A, 144 B

[56] References Cited

U.S. PATENT DOCUMENTS

| | | | |
|---|---|---|---|
| 2,396,475 | 3/1946 | Rodekurt | 273/144 B |
| 4,824,113 | 4/1989 | Lange | 273/144 B |
| 5,088,737 | 2/1992 | Frank et al. . | |
| 5,590,879 | 1/1997 | Tripp | 273/144 R |

FOREIGN PATENT DOCUMENTS

| | | | |
|---|---|---|---|
| 2389184 | 12/1978 | France | 273/144 B |
| 1574184 | 12/1971 | Germany . | |
| G8701184 | 9/1987 | Germany . | |
| 3717593 | 12/1988 | Germany . | |
| 2145266 | 3/1985 | United Kingdom . | |
| 2233806 | 1/1991 | United Kingdom . | |
| 86/07482 | 12/1986 | WIPO . | |

*Primary Examiner*—William E. Stoll
*Attorney, Agent, or Firm*—Spencer & Frank

[57] ABSTRACT

A money operated slot machine for indicating a score by displaying one of symbols and symbol combinations includes: a housing; a plurality of rotatable drums disposed in the housing and including respective drum casings, each drum casing defining compartments on an inside region thereof; a plurality of playing bodies disposed in the drum casings and being freely movable therein, the playing bodies having visible symbol identifications thereon and further being receivable in respective compartments of the drum casings; a viewing plate secured to the housing and including at least one display window disposed such that a playing body in a corresponding drum is visible therethrough; a plurality of playing body sensors disposed adjacent respective ones of the drums for sensing a value of each playing body visible through the display window; and a computer controlled control unit coupled to the sensors for evaluating symbol identifications sensed by the sensors throughout a game being played on the slot machine. The drums are disposed adjacent one another such that, at any given time, a portion of their circumferences is disposed behind and faces the viewing plate. Only the casing of each drum comprises, at least in part, a completely transparent material. Additionally, each drum further includes a frame made of one of metal and a material producing a metallic effect.

25 Claims, 2 Drawing Sheets

MONEY-OPERATED SLOT MACHINE

FIELD OF THE INVENTION

The invention relates to a money-operated slot machine which indicates a score by displaying certain symbols or symbol combinations, and in which playing bodies having a visible symbol identification move freely in rotatable drums that have compartments on the inside of their casing for receiving a playing body, with at least one playing body sensor being associated with each drum in the region of a display window for a playing body, the sensor being connected to a computer-controlled control unit for the course of the game in order to evaluate the symbol identification.

BACKGROUND OF THE INVENTION

Slot machines of the above type are known in widely-varying embodiments. For example, DE 37 17 593 C2 discloses a game machine for a game of chance that can be played after a coin has been deposited and, when certain numbers or symbols or combinations thereof are displayed, pays out a win. In this instance, playing bodies having a number and/or symbol identification that is visible to the player are disposed so as to move freely in at least one drum which rotates essentially about a horizontal axis and has compartments on the inside of its casing for individually receiving a playing body. Moreover, the game machine is equipped with at least one playing body sensor and a control unit, connected to the sensor, for displaying results and/or paying out a win.

In one embodiment of this known game machine, three adjacent drums are provided which partially overlap each other. Each drum can rotate about its own axis, which is perpendicular to the front side of the game machine housing; the two outer drums can rotate clockwise, and the center drum can rotate counterclockwise. The drums are in the shape of a cylindrical disk which is hollow inside and has a circumferential casing as well as a circular rear wall and front wall, respectively. The casing, the rear wall and the front wall of each drum are produced in one piece from a transparent material. The arrangement of the drums involving the disposition of their axes parallel to one another stipulates a relatively wide game machine design. Since at least the front wall must comprise a relatively expensive, transparent material so that the player can identify a playing body located behind the wall, and the casing must also comprise this material so that a contactless-scanning playing body sensor can identify a playing body in a compartment, the resulting production cost for the drums is high overall.

SUMMARY OF THE INVENTION

The object of the invention is to create a money-operated slot machine of the type mentioned at the outset which possesses a structurally simple, yet relatively narrow, design, has an attractive shape and can be produced inexpensively.

In accordance with the invention, this object is accomplished in that

- the drums are disposed next to each other at the side of the circumference, behind a viewing plate secured to the housing,
- only the casing of each drum comprises a completely transparent material, and
- each drum has a visible frame comprising metal or a material that produces a metallic effect.

The essential advantage achieved with the invention lies in the compact arrangement of the drums with respect to one another, and in the lateral extension of the drums, because the slot machine can accordingly be configured to be narrow. The axes of the drums are oriented in the longitudinal direction with respect to each other, that is, they extend parallel to the viewing plate. A further advantage is that, because of the transparent casing of each drum, the player can observe the playing bodies moving freely in the drum, on the one hand, and, on the other hand, the playing body sensor can scan a playing body without contact, which requires only a small outlay for transparent material. Furthermore, the visible frame of each drum comprising metal or a material that produces a metallic effect assures, on the one hand, simple assembly of the drums and, on the other hand, a visually appealing appearance of the drums.

To obtain a frame that is visually attractive, yet inexpensive to produce, in accordance with an advantageous embodiment of the invention, the frame of each drum is a vacuum-metallized plastic frame. As an alternative, it is also possible to cover the outside of each drum frame with mirror segments.

In accordance with an advantageous modification of the invention, the drums are disposed, fixed against relative rotation, on a common shaft which has a relatively large diameter with respect to the drum diameter and has a shiny metallic surface, and is connected to a drive motor. The appealing, eye-catching shaft increases the attractiveness of the slot machine. Moreover, significant savings result from the common drive for all of the drums.

In another embodiment of the slot machine, each drum is disposed, fixed against relative rotation, on a shaft which has a relatively large diameter with respect to the drum diameter and has a shiny metallic surface, with each shaft being coupled to a drive motor. This makes it possible to allow the drums to run in different directions of rotation, in addition to the appealing configuration of the shafts. In order to assure a space-saving, side-by-side drum arrangement in this case, the drive motor of each drum usefully extends, at least partially, into a corresponding notch of the drum.

A further alternative embodiment of the slot machine includes the provision of the outside of each drum with two oppositely-located axle stubs which have a relatively large diameter with respect to the drum diameter and have a metallic surface, the stubs being received in associated bearings which are open to the top, and each drum being drivable by a wheel-and-disk drive. This ensures, in addition to the striking embodiment of the axle stubs, that the drums can be exchanged quickly. Of course, the axle stubs can also be connected to each other in a through-going manner inside the drums.

In order to achieve simple illumination of the drum interior, and thus good identification of the playing bodies, in accordance with an advantageous modification of the subject of the invention, an all-around light is provided on the shaft inside each drum. So that the playing bodies located behind the read-off windows can be identified readily at the end of a game, the regions behind the read-off windows marked on the viewing plate are usefully illuminated separately by at least one lamp.

To achieve a good read-off position of the playing bodies determining the symbol combination at the end of a game, and to convey the playing bodies reliably into these read-off positions, in accordance with a further embodiment of the invention, the read-off windows on the viewing plate are disposed at the height of the drum shafts, and the compartments on the inside of each drum casing are formed by ribs that are spaced from each other corresponding to the size of the playing bodies, and are concave counter to the direction of drum rotation. The ribs are preferably formed onto the inside of each drum casing, and comprise the same transparent material as the casing. As an alternative, the drum ribs can be produced from the same material as the drum frame.

The playing bodies spinning freely in the drums are advisably configured as spheres, cylinders, squares, cubes and/or similar geometrical figures. This range of variation in the shape of the playing bodies results in a particularly attractive slot machine, because the structure of the playing bodies can vary both within the individual drums and from drum to drum. To achieve an appealing appearance of the playing bodies, the symbol identification and the upper, free surface of the playing bodies preferably comprise a material that produces a metallic effect in different colors.

In accordance with an advantageous embodiment of the invention, the playing bodies of each drum are distinguishable by a laser-beam scanning device configured as a playing body sensor whose laser beam is conducted, by at least one reflector, through the transparent drum material and to the playing body to be scanned. With this type of deflection of the laser beam, it is not necessary to dispose the laser-beam scanning device in the region behind the viewing plate, which leaves free the view of the drums disposed behind the viewing plate.

The drums are advisably driven in different directions of rotation with respect to each other. Furthermore, it is preferably possible to drive the drums counterclockwise in order to mix the playing bodies, and drive them clockwise to draw the playing bodies and subsequently stop them. To achieve a more thorough mixing of the playing bodies, in a further embodiment of the invention of the slot machine, at least one compressed-air nozzle is associated with at least one drum, at the circumference, with the casing being provided with openings for air passage. To offer the player an opportunity to influence the course of the game, it is preferably provided that the intensity of the air current exiting the compressed air nozzle can be regulated by a control device to be operated by the player. A further or alternative option for the player to influence the events of the game is for a bumper operated by the player in order to achieve a knocking effect on the drums to be associated with at least one drum. When the drum is knocked by the bumper, the playing bodies are mixed further. Of course, the bumper can also be operated in a computer-controlled manner. The use of a stop key to stop the drums offers the player a further option of affecting the events of the game.

To facilitate the player's handling of the slot machine, in accordance with a further, advantageous embodiment of the invention, a screen display or luminous strip display is disposed beneath the drums for displaying user instructions, a score plan and/or further information.

So that the slot machine, which has different counting means, can be made ready for play, a coin deposit and/or bill deposit and/or chip card slot is or are further provided for the payment of playing wagers. In this instance, playing wagers that vary with key control can be selected for a game. A game is preferably begun following the deposit of a sufficient wager for a game, either automatically with computer control, or by operation of a manual starting lever.

To offer the player more intense entertainment and thus a greater incentive to play, in a further embodiment of the invention, in addition to the drums, at least one risk playing device is provided which increases the score already attained or the further score when a risk of loss exists.

Finally, to increase the attractiveness, the slot machine is enclosed by an essentially transparent housing.

BRIEF DESCRIPTION OF THE DRAWINGS

The concept underlying the invention is described in detail in the following description by way of a plurality of embodiments illustrated in the drawings. Shown are in.

DETAILED DESCRIPTION OF THE INVENTION

Figure 1:
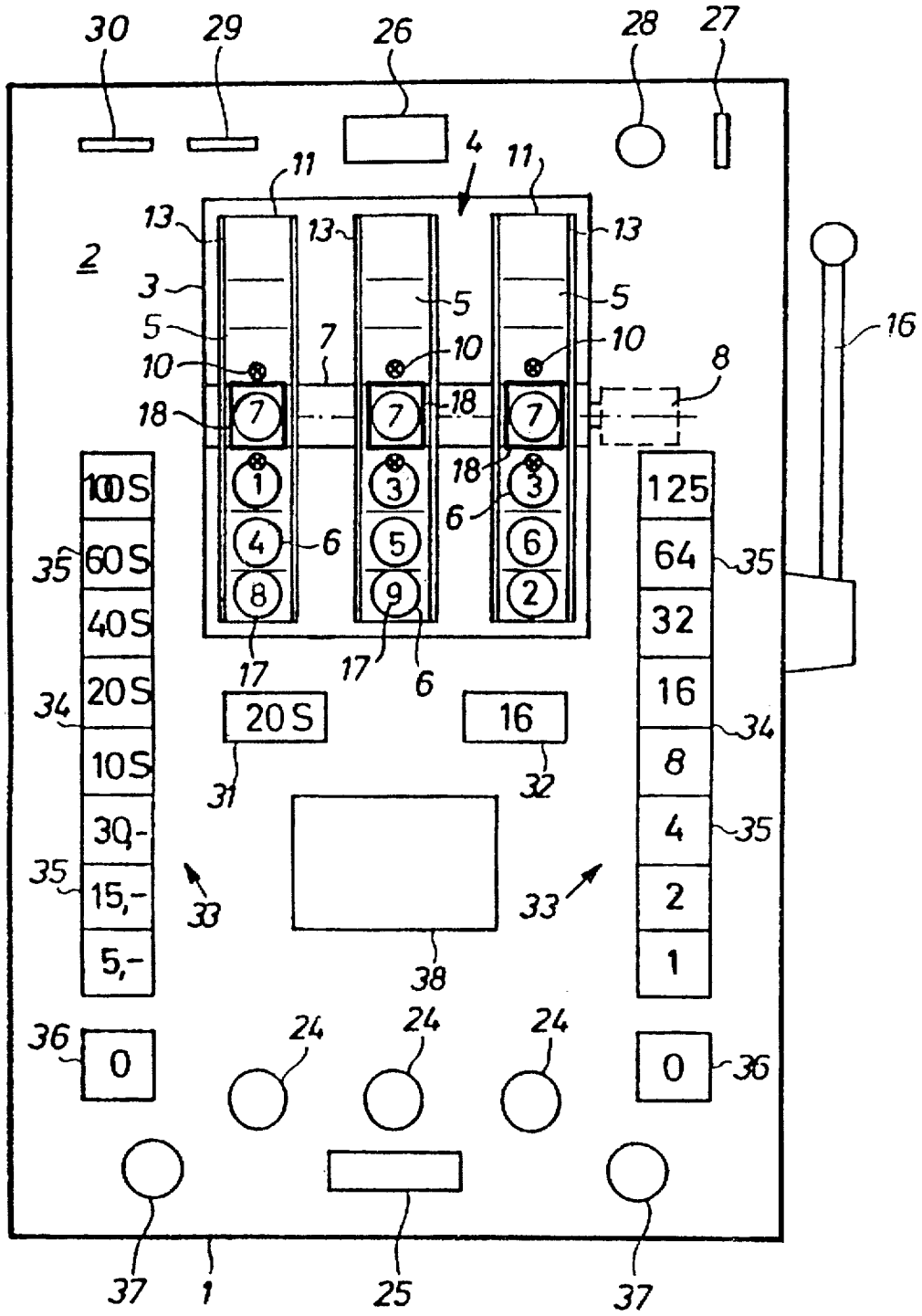
FIG. 1 a front view of the slot machine.
Figure 2:
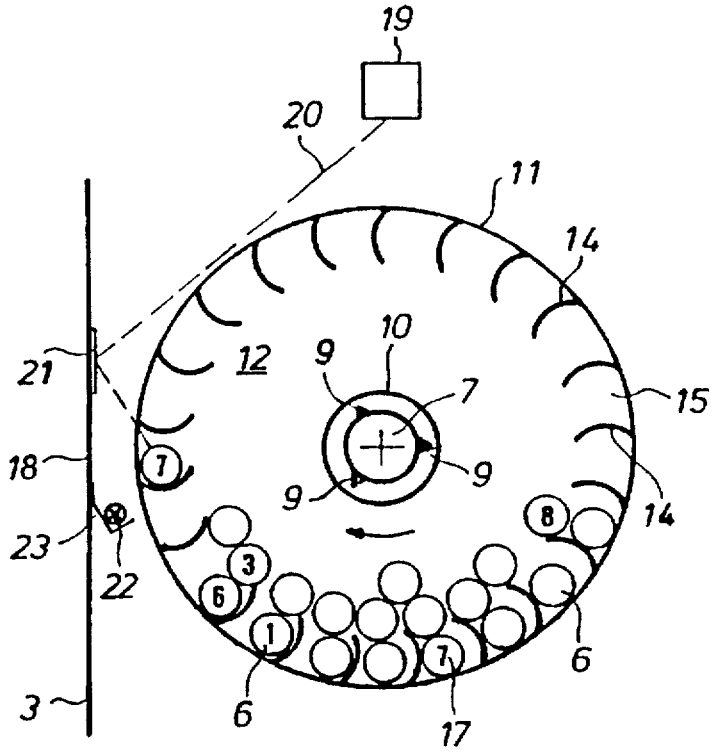
FIG. 2 a side view of a drum of the slot machine according to FIG. 1, with a few associated components, FIG. 3 an alternative type of drive for the drums of the slot machine according to FIG. 1, and FIG. 4 a further alternative type of drive for the drums of the slot machine according to FIG. 1.

The money-operated slot machine with chances to win has a housing 1 in whose front side 2 a rectangular viewing plate 3 is inserted. Behind the viewing plate 3 is a symbol playing device 4, which has at its circumference three adjacent, rotatable drums 5, each containing a plurality of freely-movable playing bodies 6. The drums 5 are disposed, fixed against relative rotation, on a common shaft 7 which extends parallel to the viewing plate 3 and at a distance therefrom, and is coupled to a drive motor 8. The shaft 7, which is provided with a shiny metallic surface, has a relatively large diameter in relation to the diameter of the drums. Inside each drum 5, an all-around light 10 is secured to the shaft by three holding elements 9 staggered by 120° with respect to each other. Each drum has the shape of a cylindrical disk that is hollow inside, and has a circumferential casing 11 and circular face walls 12 opposite the casing. The casing 11 and the face walls 12 are inserted into a metal frame 13 that can be seen through the viewing plate 3. Concave ribs 14 that are distributed around the circumference and spaced from each other such that a compartment 15 is formed between them which receives a playing body 6 without letting it be jammed project from the inside of the casing 11, counter to the direction of rotation of the drum 5. The ribs 14 and the casing 11 comprise a transparent material, and the face walls 12, in contrast, are opaque.

During rotation of the drums, which can be effected automatically by a control unit controlling the entire course of the game or manually by a manual starting lever 16, the playing bodies 6 provided at least partially with different symbol identifications 17 are mixed thoroughly and are distributed completely randomly into the various compartments 15.

The drums 5 are stopped by a pulse of a time interval random generator, which is associated with the control unit and stops the drums 5 after a specific period of rotation. The drums 5 are held in such a position that a compartment 15 occupied by a playing body 6 stops exactly behind an associated read-off window 18 marked on the viewing plate 3, with the read-off window 18 being disposed at the height of the shaft 7. The playing spheres provided with symbol identifications and appearing behind the read-off windows 18 represent the result of the game. By way of laser-beam scanning devices 19 configured as playing body sensors, the control device obtains information related to the value of the symbol identifications of the playing bodies 6 behind the read-off windows 18; the control device uses this information to evaluate the result of the game, that is, whether or not a win has occurred when a specific symbol combination appears. The laser-beam scanning devices 19 are disposed above the drums 5, and their laser beam 20 is conducted, by way of a reflector 21 correspondingly disposed on the back side of the viewing plate 3, through the transparent casing 11 of the respective drum 5 and to the playing body 6 to be scanned. Disposed beneath each read-off window 18 is a lamp 22 which has an associated reflector 23 and illuminates the space behind the read-off window 18, and thus the playing body 6 which determines the outcome of the game. The symbol identification and the remaining free surface of the playing bodies 6 comprise a material which produces a metal effect in different colors.

A plurality of actuating members 24, with which the drums 5 of the symbol playing device 4 can be held or started at a later time, are disposed in the lower region of the slot machine. In the event of a win, a win payout can be effected in cash, that is, coins are ejected into a payout basin 25, or by addition in a credit display 26, in which instance the credit can be deposited into the payout basin 25 by the actuation of a return key 28 located next to a coin deposit 27. The coin deposit 27, a bill deposit 29 and a chip card slot 30 are connected to a counting means and processing unit connected to the control unit. The outcome of a game can also be positive if, instead of or in addition to a defined monetary win, a plurality of special games is awarded in which a score key with an increased chance of winning is used. The number of special games is indicated in a special game display 31. Moreover, a win can also exist in the form of the awarding of free games, the number of which is indicated in a free game display 32.

The score attained in the symbol playing device 4 can be transferred as a wager, in a key- or computer-controlled manner, into one of the risk playing devices 33 disposed to the right and left on the front side 2. Each risk playing device 33 includes a plurality of display elements 35 combined to form a display conductor 34 which can be illuminated; in the case of the left risk playing device 33, the lower region of these elements indicates increasing monetary wins, and the upper region indicates, in ascending order, the number of special games won and, in the case of the right risk playing device 33, the elements indicate, in ascending order, the numbers of free games won. A score displayed in the display conductor 34 of one of the risk playing devices 33 is risked in that the next-higher display element 35 with respect to the illuminated display element 35 that indicates the score flashes alternatingly with a loss display element 36, identified by "0," disposed beneath the display conductor 34. When a risk key 37 is actuated, either the next higher score is attained or the current score is lost. This process can be continued until the highest number of special games or free games is attained.

Finally, a display screen 38 is also provided which serves to indicate user instructions, a score plan and/or further information.

Figure 3:
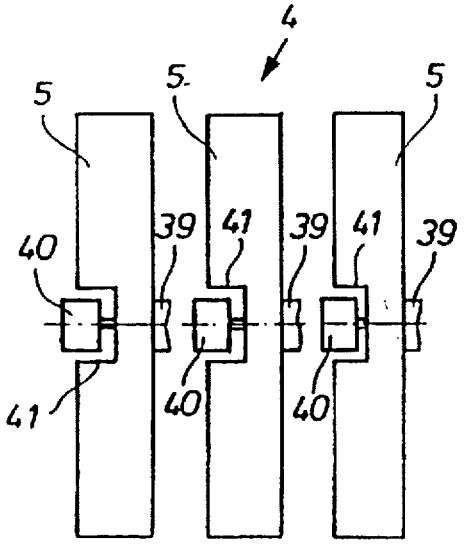

In the alternative embodiment of the symbol playing device 4 illustrated in FIG. 3, the drums 5 are individually disposed, fixed against relative rotation, on a separate shaft 39 which has a relatively large diameter with respect to the diameter of the drum 5 and is provided with a shiny metallic surface. Each shaft 39 is coupled to a drive motor 40. Each drive motor 40 engages a corresponding notch 41 of the associated drum 5.

Figure 4:
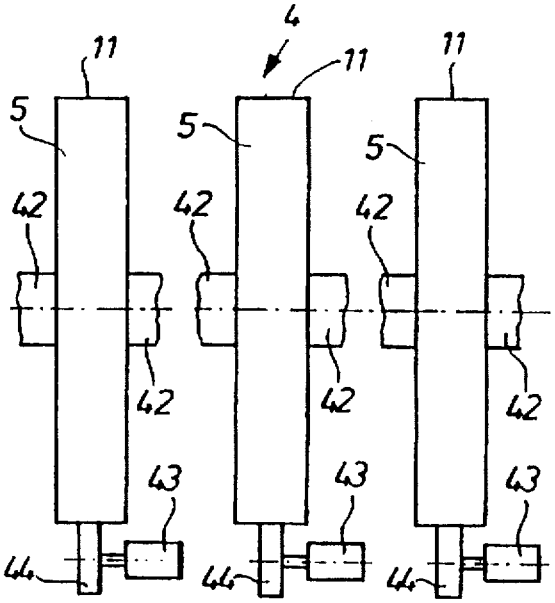

FIG. 4 shows a further alternative embodiment of the symbol playing device 4. In this instance each drum 5 is provided on the outside with two oppositely-located axle stubs 42 which have a relatively large diameter with respect to the diameter of the drum 5 and are connected to each other in a throughgoing manner inside the drums 5. The one axle stub 42 of each drum, the stub possessing a metallic surface, is received in associated bearing that are open to the top. A wheel-and-disk drive 43 whose frictional wheel 44 acts on the casing 11 of the drum 5 is associated with each drum.

What is claimed is:

1. In a money operated slot machine adapted to indicate a score by displaying one of symbols and symbol combinations, the slot machine comprising:

a housing;

a plurality of rotatable drums disposed in the housing and including respective drum casings, each drum casing defining compartments on an inside region thereof;

a plurality of playing bodies disposed in the drum casings and being freely movable therein, the playing bodies having visible symbol identifications thereon and further being adapted to be received in respective compartments of the drum casings;

a viewing plate secured to the housing and including at least one display window disposed such that a playing body in a corresponding drum is visible therethrough;

a plurality of playing body sensors disposed adjacent respective ones of the drums for sensing a value of each playing body visible through the display window;

a computer controlled control unit coupled to the sensors for evaluating symbol identifications sensed by the sensors throughout a game being played on the slot machine;

the improvement wherein:

the drums are disposed adjacent one another such that, at any given time, a portion of their circumferences is disposed behind and faces the viewing plate;

only the casing of each drum comprises, at least in part, a completely transparent material; and each drum further includes a frame made of one of metal and a material producing a metallic effect, the frame of each drum comprising a vacuum metallized plastic frame.

2. The slot machine according to claim 1, further comprising:

a drive motor; and a common shaft coupled to the drive motor and having a diameter which is relatively large with respect to a diameter of the drums, the common shaft further having a shiny metallic surface, the drums being fixed against relative rotation on the common shaft.

3. The slot machine according to claim 1, further comprising:

a plurality of drive motors; and a plurality of shafts coupled to respective ones of the drive motors, each shaft having a diameter which is relatively large with respect to a diameter of a corresponding drum and further having a shiny metallic surface, the drums being fixed against relative rotation on respective ones of the shafts.

4. The slot machine according to claim 3, wherein the drums define respective notches therein, the drive motors extending at least partially into corresponding notches on respective ones of the drums.

5. The slot machine according to claim 1, further including:

a shaft fixed to each drum; and an all-around light disposed inside each drum on the shaft fixed thereto.

6. The slot machine according to claim 1, further including a lamp for illuminating regions behind the display window.

7. The slot machine according to claim 1, further including a shaft fixed to each drum, the display window being disposed at a height of each shaft, the drum casing of each drum further including a plurality of ribs defining the compartments of the drum casing, the ribs defining concavities facing in a direction of rotation of a corresponding drum and being spaced from one another so as to allow the playing bodies to be received within the compartments.

8. The slot machine according to claim 7, wherein the ribs are disposed at an inside region of the drum casing of each drum and are made of the completely transparent material.

9. The slot machine according to claim 7, wherein the ribs are made from a material identical to a material of the frame.

10. The slot machine according to claim 1, wherein the playing bodies are configured as at least one of spheres, cylinders and cubes.

11. The slot machine according to claim 1, wherein each playing body sensor comprises:

a laser-beam scanning device adapted to generate a laser beam; and a reflector disposed in a path of the laser beam for conducting the laser beam through the transparent material of the casing of a corresponding drum to a playing body to be scanned.

12. The slot machine according to claim 1, wherein the drums are configured to rotate in different directions of rotation with respect to one another.

13. The slot machine according to claim 1, wherein the drums are configured such that the playing bodies are received by the compartments in random distribution, the drums further being adapted to be stopped in one of a key controlled manner and a time-controlled manner.

14. The slot machine according to claim 1, further comprising one of a screen display and a luminous strip display disposed beneath the drums for indicating at least one of user instructions and a score plan.

15. The slot machine according to claim 1, wherein the housing defines at least one of a coin deposit slot, a bill deposit slot and a chip card slot for a payment of wagers.

16. The slot machine according to claim 1, further comprising a key control unit for varying wagers to be selected for a game.

17. The slot machine according to claim 1, further comprising one of a computer control unit and a manual starting lever for automatically beginning a game after a sufficient wager has been deposited therefor.

18. The slot machine according to claim 1, further comprising a risk playing device for increasing a score in a game being played on the machine as a function of a risk of loss associated with the game.

19. The slot machine according to claim 1, wherein the housing is essentially transparent.

20. In a money operated slot machine adapted to indicate a score by displaying one of symbols and symbol combinations, the slot machine comprising:

a housing;

a plurality of rotatable drums disposed in the housing and including respective drum casings, each drum casing defining compartments on an inside region thereof;

a plurality of playing bodies disposed in the drum casings and being freely movable therein, the playing bodies having visible symbol identifications thereon and further being adapted to be received in respective compartments of the drum casings;

a viewing plate secured to the housing and including at least one display window disposed such that a playing body in a corresponding drum is visible therethrough;

a plurality of playing body sensors disposed adjacent respective ones of the drums for sensing a value of each playing body visible through the display window;

a computer controlled control unit coupled to the sensors for evaluating symbol identifications sensed by the sensors throughout a game being played on the slot machine;

the improvement wherein:

the drums are disposed adjacent one another such that, at any given time, a portion of their circumferences is disposed behind and faces the viewing plate;

only the casing of each drum comprises, at least in part, a completely transparent material;

each drum further includes a frame made of one of metal and a material producing a metallic effect; and the slot machine further comprises mirror segments covering an exterior region of the frame of each drum.

21. In a money operated slot machine adapted to indicate a score by displaying one of symbols and symbol combinations, the slot machine comprising:

a housing;

a plurality of rotatable drums disposed in the housing and including respective drum casings, each drum casing defining compartments on an inside region thereof;

a plurality of playing bodies disposed in the drum casings and being freely movable therein, the playing bodies having visible symbol identifications thereon and further being adapted to be received in respective compartments of the drum casings;

a viewing plate secured to the housing and including at least one display window disposed such that a playing body in a corresponding drum is visible therethrough;

a plurality of playing body sensors disposed adjacent respective ones of the drums for sensing a value of each playing body visible through the display window;

a computer controlled control unit coupled to the sensors for evaluating symbol identifications sensed by the sensors throughout a game being played on the slot machine;

the improvement wherein:

the drums are disposed adjacent one another such that, at any given time, a portion of their circumferences is disposed behind and faces the viewing plate;

only the casing of each drum comprises, at least in part, a completely transparent material;

each drum further includes a frame made of one of metal and a material producing a metallic effect; and the slot machine further comprises:

a plurality of pairs of axle stubs having a metallic surface, the axle stubs of each pair being disposed on oppositely located outside faces of a corresponding drum and having a diameter which is relatively large with respect to a diameter of the corresponding drum;

a plurality of bearings disposed in the housing and being open toward a top region of the housing, the axle stubs of each pair being received in corresponding ones of the bearings; and a wheel-and-disk drive operatively connected to the drums for driving the drums.

22. In a money operated slot machine adapted to indicate a score by displaying one of symbols and symbol combinations, the slot machine comprising:

a housing;

a plurality of rotatable drums disposed in the housing and including respective drum casings, each drum casing defining compartments on an inside region thereof;

a plurality of playing bodies disposed in the drum casings and being freely movable therein, the playing bodies having visible symbol identifications thereon and further being adapted to be received in respective compartments of the drum casings;

a viewing plate secured to the housing and including at least one display window disposed such that a playing body in a corresponding drum is visible therethrough;

a plurality of playing body sensors disposed adjacent respective ones of the drums for sensing a value of each playing body visible through the display window;

a computer controlled control unit coupled to the sensors for evaluating symbol identifications sensed by the sensors throughout a game being played on the slot machine;

the improvement wherein:

the drums are disposed adjacent one another such that, at any given time, a portion of their circumferences is disposed behind and faces the viewing plate;

only the casing of each drum comprises, at least in part, a completely transparent material;

each drum further includes a frame made of one of metal and a material producing a metallic effect; and the symbol identifications and remaining outer surfaces of the respective playing bodies are made of a material producing a metallic effect in different colors.

23. In a money operated slot machine adapted to indicate a score by displaying one of symbols and symbol combinations, the slot machine comprising:

a housing;

a plurality of rotatable drums disposed in the housing and including respective drum casings, each drum casing defining compartments on an inside region thereof;

a plurality of playing bodies disposed in the drum casings and being freely movable therein, the playing bodies having visible symbol identifications thereon and further being adapted to be received in respective compartments of the drum casings;

a viewing plate secured to the housing and including at least one display window disposed such that a playing body in a corresponding drum is visible therethrough;

a plurality of playing body sensors disposed adjacent respective ones of the drums for sensing a value of each playing body visible through the display window;

a computer controlled control unit coupled to the sensors for evaluating symbol identifications sensed by the sensors throughout a game being played on the slot machine;

the improvement wherein:

the drums are disposed adjacent one another such that, at any given time, a portion of their circumferences is disposed behind and faces the viewing plate;

only the casing of each drum comprises, at least in part, a completely transparent material;

each drum further includes a frame made of one of metal and a material producing a metallic effect; and the drums are configured to rotate in one direction for mixing the playing bodies and in another direction for drawing the playing bodies into the compartments and to be subsequently stopped.

24. In a money operated slot machine adapted to indicate a score by displaying one of symbols and symbol combinations, the slot machine comprising:

a housing;

a plurality of rotatable drums disposed in the housing and including respective drum casings, each drum casing defining compartments on an inside region thereof;

a plurality of playing bodies disposed in the drum casings and being freely movable therein, the playing bodies having visible symbol identifications thereon and further being adapted to be received in respective compartments of the drum casings;

a viewing plate secured to the housing and including at least one display window disposed such that a playing body in a corresponding drum is visible therethrough;

a plurality of playing body sensors disposed adjacent respective ones of the drums for sensing a value of each playing body visible through the display window;

a computer controlled control unit coupled to the sensors for evaluating symbol identifications sensed by the sensors throughout a game being played on the slot machine;

the improvement wherein:

the drums are disposed adjacent one another such that, at any given time, a portion of their circumferences is disposed behind and faces the viewing plate;

only the casing of each drum comprises, at least in part, a completely transparent material;

each drum further includes a frame made of one of metal and a material producing a metallic effect; and the slot machine further comprises a compressed air nozzle disposed adjacent at least one of the drums at the circumference thereof, the casing of the at least one of the drums defining air flow-through openings therein.

25. In a money operated slot machine adapted to indicate a score by displaying one of symbols and symbol combinations, the slot machine comprising:

a housing;

a plurality of rotatable drums disposed in the housing and including respective drum casings, each drum casing defining compartments on an inside region thereof;

a plurality of playing bodies disposed in the drum casings and being freely movable therein, the playing bodies having visible symbol identifications thereon and further being adapted to be received in respective compartments of the drum casings;

a viewing plate secured to the housing and including at least one display window disposed such that a playing body in a corresponding drum is visible therethrough;

a plurality of playing body sensors disposed adjacent respective ones of the drums for sensing a value of each playing body visible through the display window;

a computer controlled control unit coupled to the sensors for evaluating symbol identifications sensed by the sensors throughout a game being played on the slot machine;

the improvement wherein:

the drums are disposed adjacent one another such that, at any given time, a portion of their circumferences is disposed behind and faces the viewing plate;

only the casing of each drum comprises, at least in part, a completely transparent material;

each drum further includes a frame made of one of metal and a material producing a metallic effect; and the slot machine further comprises a bumper disposed adjacent at least one drum for creating a knocking effect thereon.

* * * * *